US006241495B1

(12) United States Patent
Chang

(10) Patent No.: US 6,241,495 B1
(45) Date of Patent: Jun. 5, 2001

(54) MODIFIED POSITIONING MECHANISM FOR STATIONARY SCROLL OF SCROLL COMPRESSOR

(75) Inventor: Lung-Tsai Chang, Hsin Chu (TW)

(73) Assignee: Rechi Precision Co., Ltd., Tao Yuan Hsien (TW)

( * ) Notice: Subject to any disclaimer, the term of this patent is extended or adjusted under 35 U.S.C. 154(b) by 0 days.

(21) Appl. No.: 09/432,265

(22) Filed: Nov. 2, 1999

(51) Int. Cl.[7] ..... F04C 18/00
(52) U.S. Cl. ..... 418/55.5; 418/55.1
(58) Field of Search ..... 418/55.5, 55.1

(56) References Cited

U.S. PATENT DOCUMENTS

| | | | | |
|---|---|---|---|---|
| 4,383,805 | * | 5/1983 | Teegarden et al. | 418/55.1 |
| 4,413,959 | * | 11/1983 | Butterworth | 418/55.1 |
| 4,431,388 | * | 2/1984 | Eber et al. | 418/55.1 |
| 5,407,335 | * | 4/1995 | Caillat et al. | 418/55.5 |
| 5,411,384 | * | 5/1995 | Bass et al. | 418/55.5 |
| 5,527,166 | * | 6/1996 | Chang et al. | 418/55.5 |
| 5,551,851 | * | 9/1996 | Williams et al. | 418/55.1 |
| 5,580,230 | * | 12/1996 | Keifer et al. | 418/55.5 |
| 5,984,653 | * | 11/1999 | Misiak | 418/55.1 |
| 6,056,523 | * | 2/2000 | Won et al. | 418/55.1 |

FOREIGN PATENT DOCUMENTS

| | | | | |
|---|---|---|---|---|
| 61-098987 | * | 5/1986 | (JP) | 418/55.1 |
| 5-018202 | * | 1/1993 | (JP) | 418/55.1 |
| 6-093982 | * | 4/1994 | (JP) | 418/55.1 |

* cited by examiner

*Primary Examiner*—Thomas Denion
*Assistant Examiner*—Theresa Trieu
(74) *Attorney, Agent, or Firm*—Rosenberg, Klein & Lee

(57) ABSTRACT

The present invention provides a modified positioning mechanism for the stationary scroll of a scroll compressor. Two opposed positioning blocks are installed on a frame of the scroll compressor. A vertically arranged fixing hole is disposed at each positioning block. A positioning bolt is fixed in each fixing hole. Two bumps extend from two sides of the stationary scroll of the scroll compressor. A vertically arranged positioning hole is disposed at each bump. The top of the positioning bolt is inserted in the positioning hole of the stationary scroll. Thereby process accuracy can be easily controlled, and components and products of inferior quality can be effectively reduced.

1 Claim, 5 Drawing Sheets

MODIFIED POSITIONING MECHANISM FOR STATIONARY SCROLL OF SCROLL COMPRESSOR

FIELD OF THE INVENTION

The present invention relates to a modified positioning mechanism for the stationary scroll of a scroll compressor and, more particularly, to a positioning mechanism which can reduce products of inferior quality and let process accuracy be easily controlled.

BACKGROUND OF THE INVENTION

As shown in FIG. 1, a scroll compressor in prior art comprises an orbiting scroll 1, a stationary scroll 2, an isolating block 3, and a frame 4. The orbiting scroll 1 is led to orbit the stationary scroll 2 such that low-pressure working fluid is led into, compressed through continuous orbital motion of the orbiting scroll 2, and discharged at high-pressure state via a discharge port at the center of the stationary scroll 2. The compression stroke of working fluid is thus completed.

As shown in FIGS. 1 and 2, two positioning blocks 5 are installed on the frame 4. The two positioning blocks 5 are arranged at two opposed positions to limit the motion of the stationary scroll 2. A fixing hole 7 is drilled at each positioning block 5. A positioning bolt 6 is fixed in each fixing hole 7. The two positioning bolts 6 are horizontally arranged. One end of the positioning bolt 6 is inserted in the stationary scroll 2 to prevent the stationary scroll from rotating.

However, in the positioning mechanism for the stationary scroll of a conventional scroll compressor, the fixing hole 7 at the positioning block 5 must be drilled twice. The angle accuracy can not be easily controlled. Moreover, it is difficult to align the two positioning bolts 6 in a straight line. Therefore, it is hard to control the quality, resulting in more products of inferior quality.

SUMMARY AND OBJECTS OF THE PRESENT INVENTION

Accordingly, the primary object of the present invention is to provide a modified positioning mechanism for the stationary scroll of a scroll compressor. The present invention is characterized in that the two positioning bolts fixed by the positioning blocks on the frame of the scroll compressor are vertically arranged. The fixing holes at the positioning blocks for fixing the positioning bolts are vertically arranged. Process accuracy of the fixing holes can be easily controlled, and components and products of inferior quality can be effectively reduced.

The various objects and advantages of the present invention will be more readily understood from the following detailed description when read in conjunction with the appended drawings, in which:

DETAILED DESCRIPTION OF THE PREFERRED EMBODIMENTS

Figure 1:
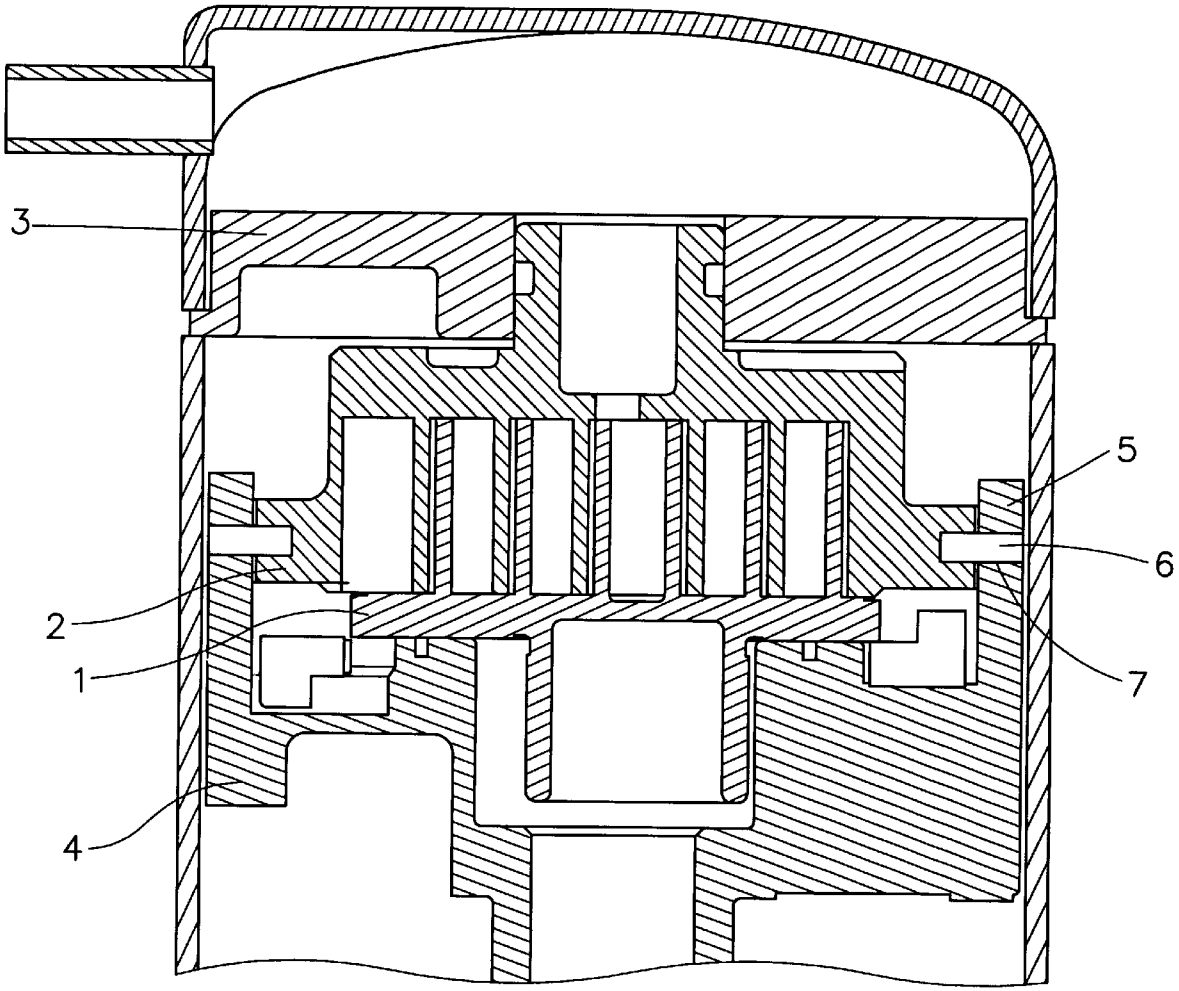
FIG. 1 PRIOR ART
FIG. 1 is a cross-sectional view of a conventional scroll compressor.
Figure 2:
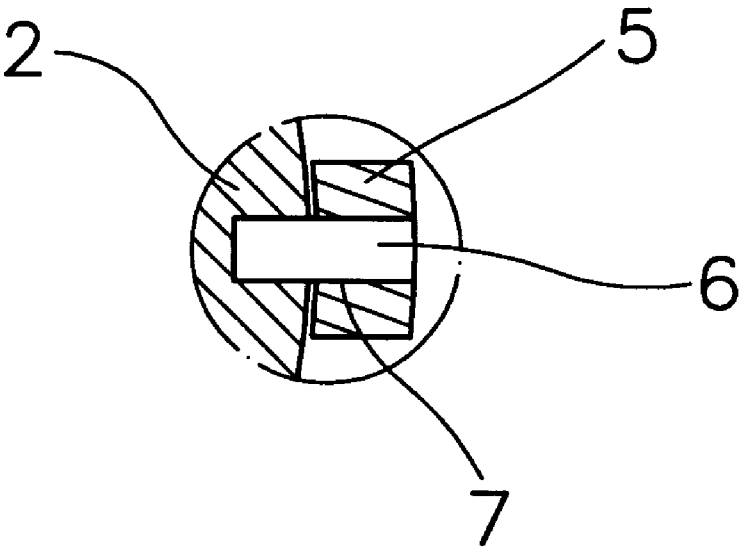
FIG. 2 PRIOR ART
FIG. 2 is a locally top view of the positioning mechanism for the stationary scroll of a conventional scroll compressor.
Figure 3:
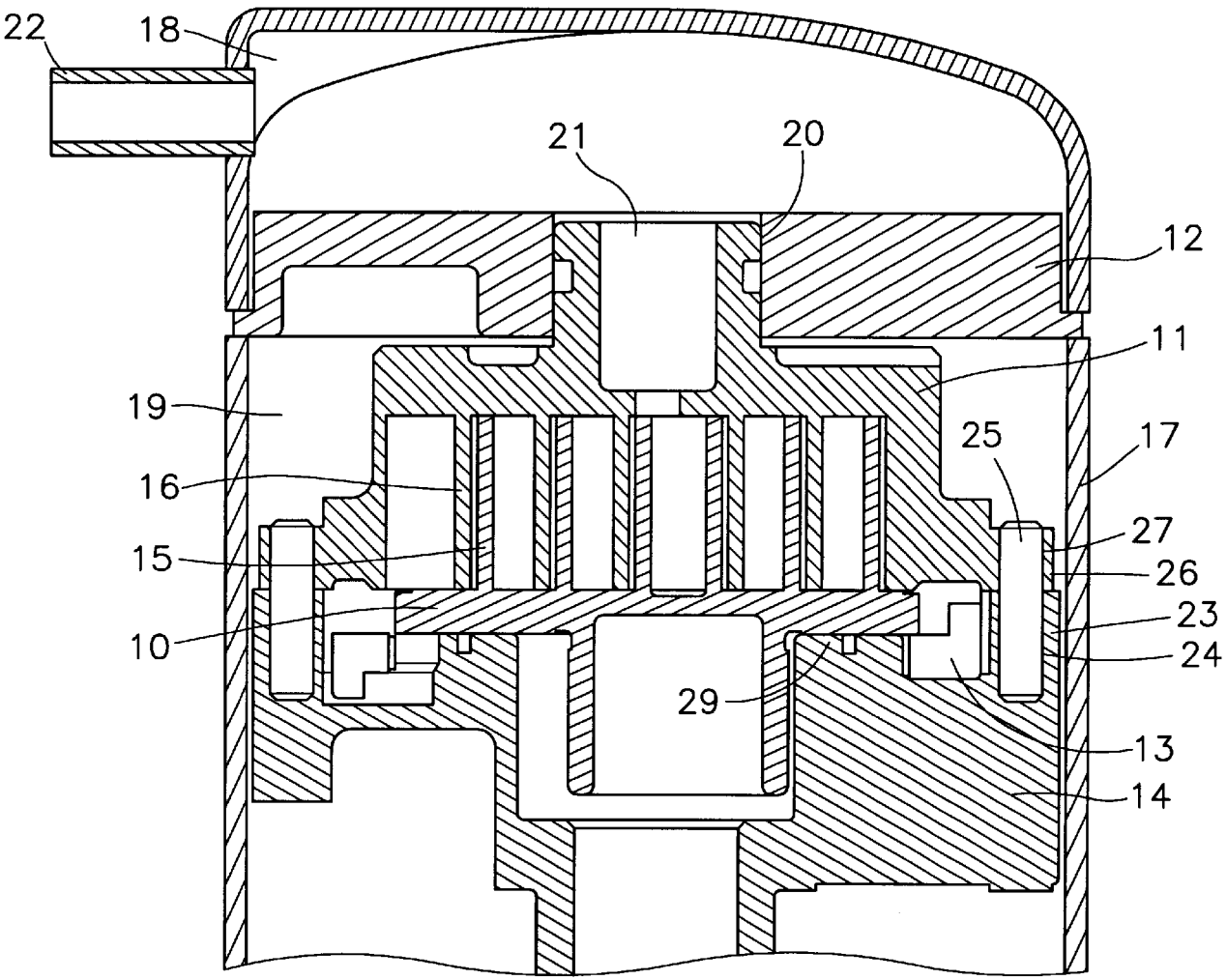
FIG. 3 is a front view according to an embodiment of the present invention.
Figure 4:
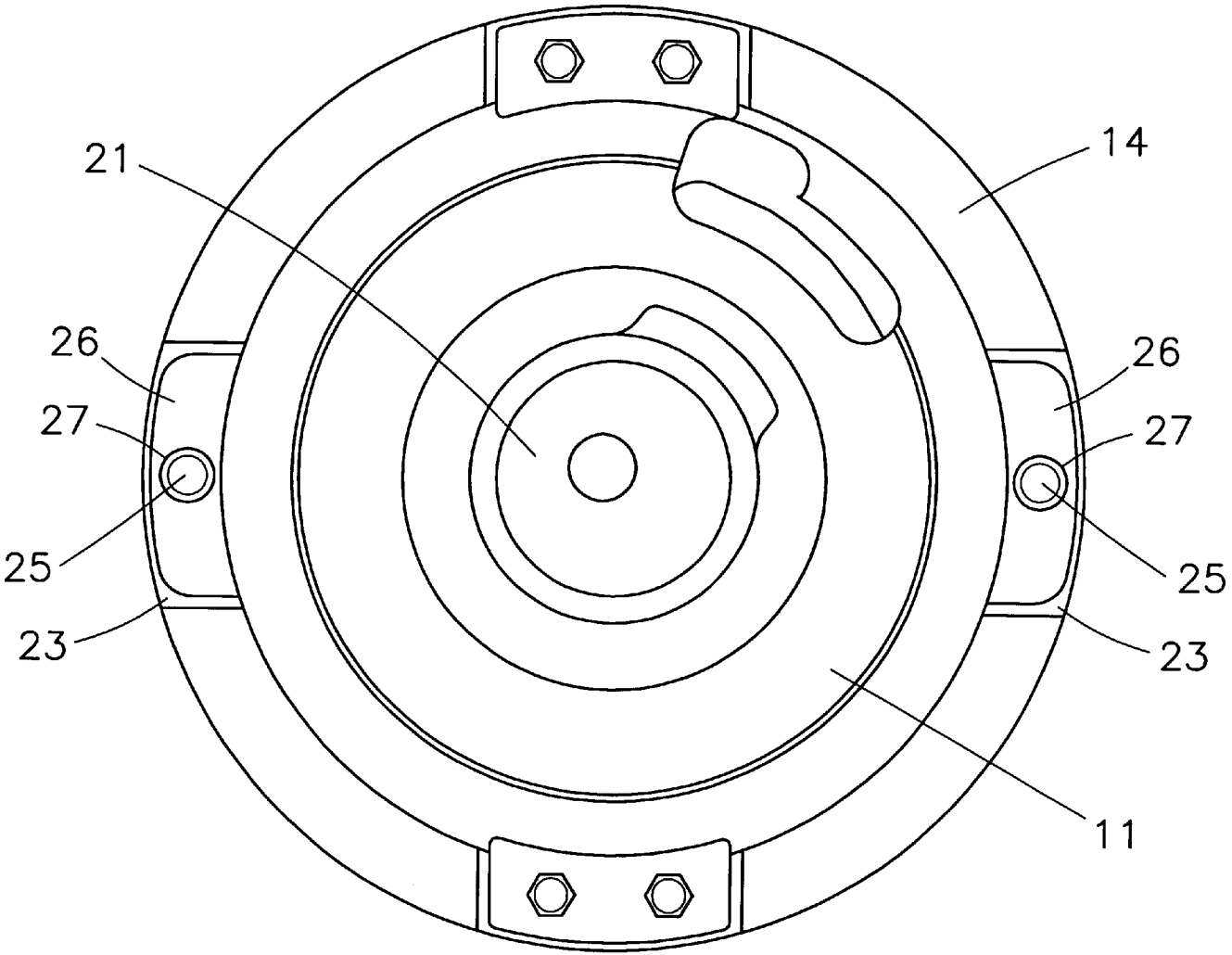
FIG. 4 is a top view according to an embodiment of the present invention.

As shown in FIGS. 3 and 4, the present invention proposes a modified positioning mechanism for the stationary scroll of a scroll compressor. The scroll compressor comprises an orbiting scroll 10, a stationary scroll 11, an isolating block 12, an Oldham ring 13, and a frame 14. The orbiting scroll 10 and the stationary scroll 11 are installed above the frame 14. The orbiting scroll 10 and the stationary scroll 11 are meshed to form a plurality of compression rooms of closed space. The Oldham ring 13 is installed at top of the frame 14. When the orbiting scroll 10 is driven, the Oldham ring 13 can be used to control the orbiting scroll such that it can only orbit but can not rotate on its axis. The orbiting scroll 10 is pressed by the stationary scroll 11 to stick to the frame 14. The orbiting scroll 10 and the stationary scroll 11 respectively have a plurality of spiral scroll plates 15 and 16 with a plurality of compression rooms forming between them. The isolating block 12 is fixed inside a shell 17 of the scroll compressor and partitions the shell into a high-pressure chamber 18 and a low-pressure chamber 19. A through hole 20 is disposed at the center of the isolating block to connect the two chambers 18 and 19. When low-pressure working fluid is sucked into the compression rooms via a suction port, the working fluid is pressed to be discharged via a through discharge port 21 at the center of the stationary scroll 11 through the continuous orbital motion of the orbiting scroll 10. High-pressure working fluid is then discharged out of the scroll compressor via an exit 22 at the shell 17 of the scroll compressor.

In the present invention, two positioning blocks 23 are installed on the frame 14 and are arranged at two opposed positions. The two positioning blocks 23 are located at a lower height. A fixing hole 24 is drilled at each positioning block 23. The two fixing holes 24 are vertically arranged. A positioning bolt 25 is installed in each fixing hole 24 such that the two positioning bolts are vertically arranged. Two bumps 26 extend from two sides of the stationary scroll 11. The bottom of the two bumps 26 is even with the bottom of the stationary scroll 11 and is fixed on the frame 14 so as to support the stationary scroll 11 and reduce its friction and abrasion. A vertically arranged positioning hole 27 is drilled at each bump 26. The top of the positioning bolt 25 is inserted in the positioning hole 27 of the stationary scroll 11 to prevent the stationary scroll from rotating. A positioning mechanism for the stationary scroll is thus formed.

Figure 5:
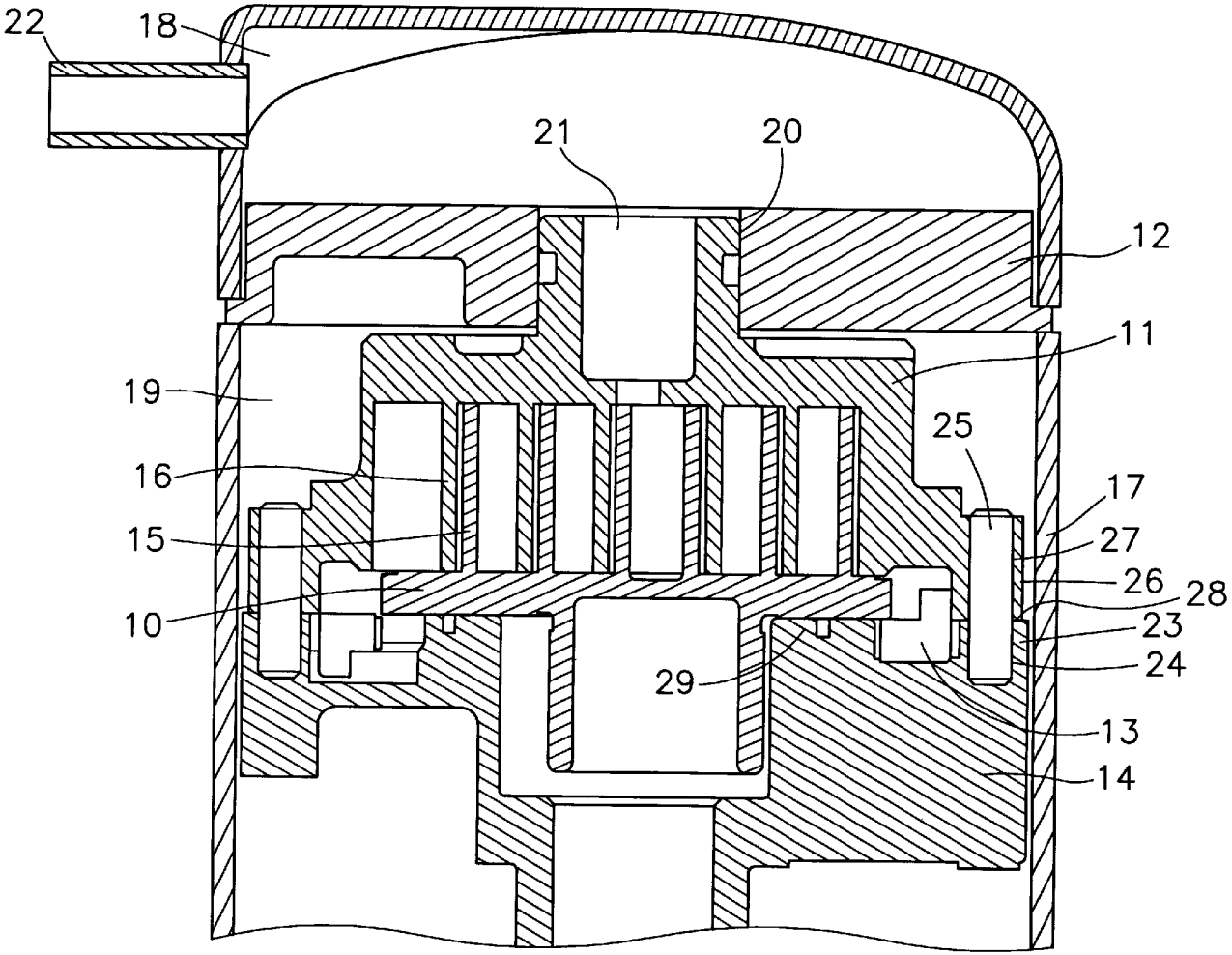
FIG. 5 is a front view according to another embodiment of the present invention.

As shown in FIG. 5, the height of the positioning block 23 for positioning the positioning bolt 25 on the frame 14 can be lowered. The top plane of the positioning block 23 forms a positioning plane 28. The positioning plane 28 is lowered to the same height as that of an anti-push plane 29 on the top of the frame 14. The bottom of the bump 26 of the stationary scroll 11 is relatively raised and matched with the positioning plane 28 of the positioning block 23. In addition to advantages of the above mentioned embodiment, the anti-push plane 29 of the frame 114 can be ground simultaneously with the positioning plane 28 of the positioning block 23 such that accuracy is increased and processing of the anti-push plane 29 is easier.

The present invention is characterized in that the positioning bolts 25 are vertically arranged and the fixing holes 24 for fixing the positioning bolts 25 on the two positioning blocks 23 are also vertically arranged. Process accuracy of the fixing holes 24 can be easily controlled, and components and products of inferior quality can be effectively reduced.

To sum up, the present invention can overcome the problems, such as that the fixing hole at the fixing block must be drilled twice, that angle accuracy and thus quality can not be easily controlled, and that more products of inferior quality are produced, of the positioning mechanism for the stationary scroll of a scroll compressor in prior art.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A modified positioning mechanism for a stationary scroll of a scroll compressor, comprising:

an orbiting scroll;

a frame having a surface portion defining an anti-push plane beneath said orbiting scroll and two positioning blocks installed on said frame, each of said two positing blocks having an upper surface formed coplanar with said anti-push plane and a vertically arranged fixing hole formed therein;

a stationary scroll disposed above said orbiting scroll and coupled to said frame, said stationary scroll having two bumps respectively extending from two sides of said stationary scroll, each of said bumps having a vertically arranged positioning hole formed therethrough in respective aligned relationship with a corresponding one of said vertically arranged fixing holes of said positioning blocks; and, a pair of positioning bolts respectively passing through said positioning holes and secured to said fixing holes for coupling said stationary scroll to said frame.

* * * * *